US007411378B2

(12) United States Patent
Lathrop et al.

(10) Patent No.: US 7,411,378 B2
(45) Date of Patent: Aug. 12, 2008

(54) POWER FACTOR CONTROLLER THAT COMPUTES CURRENTS WITHOUT MEASURING THEM

(75) Inventors: Olin Lathrop, Groton, MA (US); David Tweed, Lowell, MA (US)

(73) Assignee: Embed, Inc., Littleton, MA (US)

( * ) Notice: Subject to any disclaimer, the term of this patent is extended or adjusted under 35 U.S.C. 154(b) by 211 days.

(21) Appl. No.: 11/124,855

(22) Filed: May 9, 2005

(65) Prior Publication Data

US 2005/0248323 A1 Nov. 10, 2005

Related U.S. Application Data

(60) Provisional application No. 60/569,472, filed on May 7, 2004.

(51) Int. Cl.
*G05F 1/56* (2006.01)

(52) U.S. Cl. ..... 323/283; 323/241; 323/246; 363/21.03; 363/45; 363/86

(58) Field of Classification Search ..... 323/222, 323/223, 211, 229, 232, 235, 241, 246, 247, 323/259, 265, 271, 282, 283, 301, 355, 358, 323/275; 363/13, 15, 17, 18, 19, 21.01, 21.03, 363/22, 23, 24, 25, 39, 45, 46, 59, 60, 74, 363/84, 86, 88, 89

See application file for complete search history.

(56) References Cited

U.S. PATENT DOCUMENTS

| | | | | |
|---|---|---|---|---|
| 6,037,754 | A * | 3/2000 | Harper | 323/222 |
| 6,150,771 | A * | 11/2000 | Perry | 315/291 |
| 6,556,462 | B1 * | 4/2003 | Steigerwald et al. | 363/89 |
| 6,594,158 | B2 * | 7/2003 | Batarseh et al. | 363/16 |
| 7,015,682 | B2 * | 3/2006 | Santin et al. | 323/285 |
| 2004/0047166 | A1 * | 3/2004 | Lopez-Santillana et al. | 363/89 |
| 2004/0062058 | A1 * | 4/2004 | Hann et al. | 363/15 |
| 2004/0150380 | A1 | 8/2004 | Santin et al. | |
| 2005/0088864 | A1 * | 4/2005 | Montorsi et al. | 363/125 |
| 2005/0168198 | A1 * | 8/2005 | Maksimovic et al. | 323/222 |

* cited by examiner

*Primary Examiner*—Jeffrey L. Sterrett
*Assistant Examiner*—Stuart Hansen
(74) *Attorney, Agent, or Firm*—Vern Maine & Associates

(57) ABSTRACT

A power factor controller for a switching power supply, that in one embodiment couples a power factor control circuit between an AC input and an output wherein a digital controller computes circuit currents for regulating the power supply without direct current measurements.

20 Claims, 5 Drawing Sheets

POWER FACTOR CONTROLLER THAT COMPUTES CURRENTS WITHOUT MEASURING THEM

RELATED APPLICATIONS

This application claims the benefit of U.S. Provisional Application No. 60/569,472, filed May 7, 2004, which is herein incorporated in its entirety by reference.

FIELD OF THE INVENTION

The invention relates to switching power supplies, and in particular to a type of switching power supply that implements "power factor correction" (PFC).

BACKGROUND OF THE INVENTION

Traditional AC to DC power supplies typically use a full wave bridge feeding a storage capacitor. The capacitor is fully charged twice per power line cycle at the peak of the full wave rectified sine wave, wherein a heavy pulse is drawn from the power line just before each peak, and little or no current at other times. A sufficiently sized capacitor maintains the load voltage relatively constant to the level required by the load, and the load is powered from the stored energy between the power line peaks. Electronic devices such as televisions, VCRs, and computers, typically employ a full wave bridge to make a DC voltage that is used as the input to one or more switching power supplies. The switching power supplies then provide the regulated DC voltages used by the rest of the system.

Advances in power semiconductors and the availability of inexpensive off the shelf control chips have increased the popularity of switching power supplies and expanded the usage as well as producing more sophisticated power schemes that handle higher power levels. However, this expanded usage and popularity has also created certain problems.

Power plant generators produce sine wave voltages and these generators function most efficiently when the load currents are also sine waves. Among other things, it allows for a constant torque on the generator shaft and minimizes mechanical stresses. The use of full wave bridges that draw power via a short spike twice per line cycle tends to cause an imbalance in the generation scheme. In addition, the transformers and other power transmission equipment only handle current up to some maximum peak level and having these full bridge circuits drawing power during short periods increases the peak currents at the same power level. Furthermore, the deviation caused by the full bridge operation generates significant harmonic content at high frequencies that can interfere with radio communication and other electronic equipment.

In view of these problems, the industry and governments have made efforts to minimize the effects from the periodic power draws for the full bridge operations. For example, regulations have already been enacted in the European Union that constrains the range that the load current may deviate from a pure sine in phase with the voltage for some types of loads. These regulations will likely get tighter in the future, be applied to smaller loads, and spread to other regions.

Certain technological solutions have been attempted with limited success. One approach is to insert a passive filter between the power line and the equipment drawing power in short spikes. The power line is then presented with a 'smoother' load current. These passive filters can be effective at reducing the radio frequency harmonics, but require prohibitively heavy, large, and expensive inductors to make the load appear sufficiently close to sinusoidal.

One scheme to address the problems caused by the periodic power draw is through power factor correction (PFC). PFC uses an active electronic technique to present a sinusoidal load to the power line regardless of the characteristics of the final load. There are a number of PFC topologies for achieving this. A common type is a type of switching power supply called a boost converter. The boost converter performs PFC by taking the raw rectified AC line as input and switches at many times the power line frequency such that the power line voltage changes relatively little between each boost pulse. The boost converter produces a voltage somewhat higher than the highest peak of the AC input line. For each boost pulse, the average current drawn from the AC line for that pulse interval is proportional to the instantaneous AC line voltage. The current drawn from the AC line is therefore sinusoidal and in phase with the voltage. Ideally, the load on the AC line appears resistive.

Although the current drawn from the AC line is dictated by the AC line voltage, the boost switcher output voltage is still controlled, but much more slowly than at each switching pulse. In other words, the resistance of the resistive load presented to the AC line is slowly varied according to the demands of the final load. The line current is still mostly proportional to the line voltage, but this proportionality "constant" is slowly varied over a number of line cycles.

The output of the boost switcher is therefore a DC voltage a bit higher than the AC line peak voltage with significant ripple at twice the line frequency.

Thus, the purpose of a PFC power supply is to draw power from an AC voltage (usually the power line) in such a way that the instantaneous current drawn is proportional to the instantaneous voltage. The current waveform therefore has the same shape and phase as the voltage waveform. Another way of stating this is that the load looks resistive to the AC line. This is desirable for many reasons well known in the art.

FIG. 1 shows one type of prior art PFC power supply known in the art. The raw AC input voltage is first full-wave rectified, and inductor 2, switch 3, and diode 4 form a boost type switching power supply. When switch 3 is closed, the absolute value of the AC input voltage is applied directly across inductor 2. The inductor current then rises linearly at a rate proportional to the absolute value of the AC input voltage at that time. This stores energy in inductor 2. When switch 3 is opened, inductor 2 will produce whatever voltage is required to force the same current to flow thru it until it is discharged. The only path this current can take is thru diode 4. Capacitor 5 charges to a higher voltage than the AC line input level. The current thru inductor 2 therefore decreases at a rate proportional to the voltage on capacitor 5 minus the absolute value of the AC input voltage at that time. It is important to note that the total time for inductor 2 to charge and discharge is very small compared to one AC line cycle, and the AC line voltage can therefore be considered constant during one charge/discharge cycle, or "switching pulse".

The net result of the boost switching power supply formed by inductor 2, switch 3, diode 4, and capacitor 5 is that the voltage on capacitor 5 is higher than any point on the AC power line waveform. If this were not the case, then capacitor 5 would be charged directly thru inductor 2 and diode 4 until it is at the maximum of the AC power line. Any switching pulses would then raise it even further.

The switching element is shown as a simple switch 3 in the diagram. For the purpose of this discussion, it acts like a switch under control of the control element 6. In most cases switch 3 would be implemented as a transistor.

Note that the current drawn from the AC line is a function of how often and how long switch 3 is closed. In a PFC supply, these parameters are deliberately controlled so that the current drawn from the AC line is proportional to its voltage averaged over each pulse interval. To achieve this, the control element 6 requires the absolute value of the AC line input voltage 8 and the current being drawn from the AC line 7 as inputs. In the traditional scheme, control 6 uses feedback to null the difference between the input voltage signal 8 and the input current signal 7. If the current is too low, then switch 3 is closed more often and/or for longer, and vice-versa if the current is too high.

To be a useful power supply, the output voltage must be regulated within some limits. This is the purpose of feedback path 9 into the control element. However, the control element must typically respond to this feedback slowly or the PFC function is defeated. In essence, the PFC function presents a restive load to the AC line, and feedback 9 is used to slowly adjust that resistance to maintain a roughly uniform output voltage. Since the control element 6 can only respond slowly (several AC input cycles) to the feedback 9, the output voltage will have "ripple" on it due to the input AC line cycles. A careful tradeoff is used in processing the feedback 9 to be as responsive as possible to output load changes while not responding to the ripple caused by the AC input waveform.

Control element 6 has traditionally been implemented with analog electronics, which are well suited to adjusting an output to null the error between feedback signals. Recent advances in digital microcontrollers have allowed for the same control scheme to be implemented in digital electronics, although existing digital implementations merely perform the same control operations previously performed by analog electronics.

What is needed, therefore, are techniques and devices for improving the PFC design. Such a PFC design should be simple and easily integrated into current manufacturing technologies and devices. The system should more fully exploit the digital processing capabilities to provide a more efficient and powerful topology.

SUMMARY OF THE INVENTIONS

One embodiment of the present invention implements the PFC control element digitally and employs digital logic to implement control algorithms. The control electronics of switching PFC power supplies previously known in the art were either analog or were digital but still performed the same computations previously performed by analog electronics. These control operations were limited to addition, subtraction, multiplication by a constant, and integration.

An aspect of the invention eliminates the current sense block and its feedback path. Digital computations are performed to control the input current outright without using feedback or sensing. The digital computations include a divide and a square root, both of which are unique in the control of a PFC power supply, and which are not reasonably tractable using analog electronics.

Another aspect of the invention is to use a new control scheme to digitally compute the output ripple caused by the PFC function. This ripple is subtracted from the measured output voltage to yield only that part of the output voltage variation due to the load. This part of the output voltage variation can be tightly controlled without compromising the PFC function and results in a PFC power supply with improved output voltage regulation compared to previous designs.

In one embodiment the invention, there is a power factor controller for a switching power supply, comprising an AC input and a power factor correction circuit coupled to the AC input and providing a DC output to a load. The PFC circuit comprises an inductor, a diode, a switching element, an output storage capacitor and a digital controller, and the controller processes a current equation without a current sensing. The current equation is typically processed each switching pulse to determine a closed or 'on' time of the switching element to keep an AC input current proportional to an AC input voltage. A variation includes the power factor controller wherein the AC input is a fixed frequency.

In addition, the power factor controller can also operate in a discontinuous mode, wherein a current of the inductor goes to zero during each switching pulse.

A further aspect of the power factor controller includes a switching period (T1) of the switching element, which can be calculated by: T1=sqrt(2*Tp*L*(Vo−Vac)/(Vo*R)). In a further variation, at least two of the equation elements Tp, L, and R can be combined into a PFC control value (K). The PFC control value (K) can be used for equation elements 2, Tp, L, R, wherein the switching period (T1) is calculated by:

$$T1=\mathrm{sqrt}(K*(Vo-Vac)/Vo).$$

Another feature of the invention includes deriving a set of load characteristics that are used to adjust an effective resistance presented to the AC input and match the requirements of the load. In another aspect, the power factor controller can process a computed charge amount, wherein the charge amount is transferred to the output storage capacitor over a switching pulse, and wherein the controller uses the computed charge amount and measurements of the output voltage to compute characteristics of the load.

The power factor controller, wherein the controller derives output load characteristics and changing an effective resistance to the AC input.

A further embodiment of the invention includes a method for performing power factor correction of a switched power supply comprising measuring an AC input voltage, measuring an output voltage, processing a switch 'on' time and a switch 'off' time for a new pulse to keep an AC input current proportional to the AC input voltage, wherein the processing is done without a current measurement, switching a switching member 'on' for the switch 'on' time; and switching the switching member 'off' for the switch 'off' time. A further aspect includes processing at least one of a divide function and a square root function.

Another aspect includes computing an output voltage ripple. The method also includes subtracting the output voltage ripple from a measured output voltage and adjusting an effective resistance to the AC input.

An embodiment of the invention is a control system for a switching power supply, comprising a power factor control circuit coupled between an AC input and a DC output wherein a digital controller of the circuit computes circuit currents for regulating the power supply without direct current measurements. The power factor control circuit in one aspect comprises an inductor, a switching element, a diode, and an output storage capacitor. The system can operate in a discontinuous mode and at a fixed frequency.

A further aspect includes calculating a switching period (T1) of the switching element per pulse according to: T1=sqrt (2*Tp*L*(Vo−Vac)/(Vo*R)). In some instances, certain values are assumed to be constants, and a PFC control value (K) is used to compute the switching period: T1=sqrt(K*(Vo−Vac)/Vo).

A system wherein the controller processes a computed charge amount over a switching pulse and uses the computed charge amount and output voltage measurements to compute the load characteristics. The load characteristics can be used to adjust the effective resistance presented to the AC input.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTIONS

The present invention implements a power factor control scheme that operates without making a current measurement but instead employs digital processing to calculate the necessary parameters. While described using the boost converter, the techniques are applicable to other PFC topologies.

Figure 1:
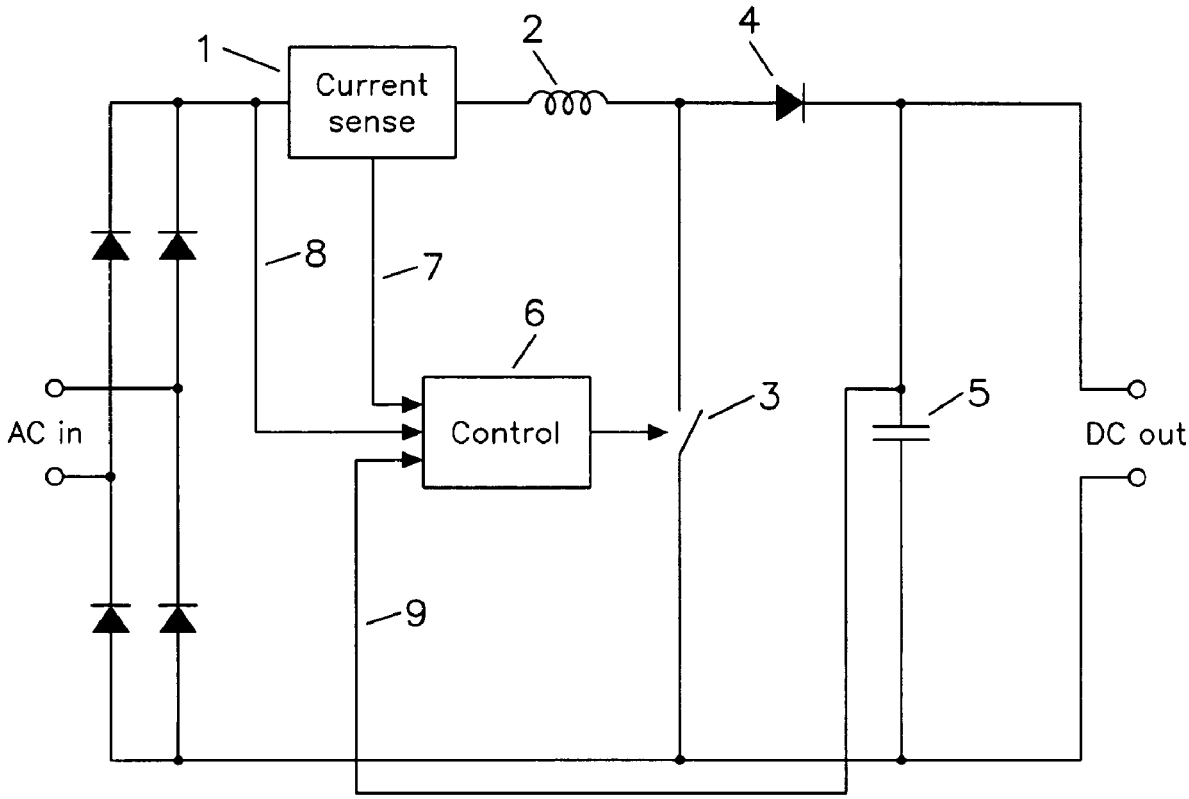
FIGURE 1 (Prior Art)
FIG. 1 is a prior art diagram of a PFC power supply.
Figure 2:
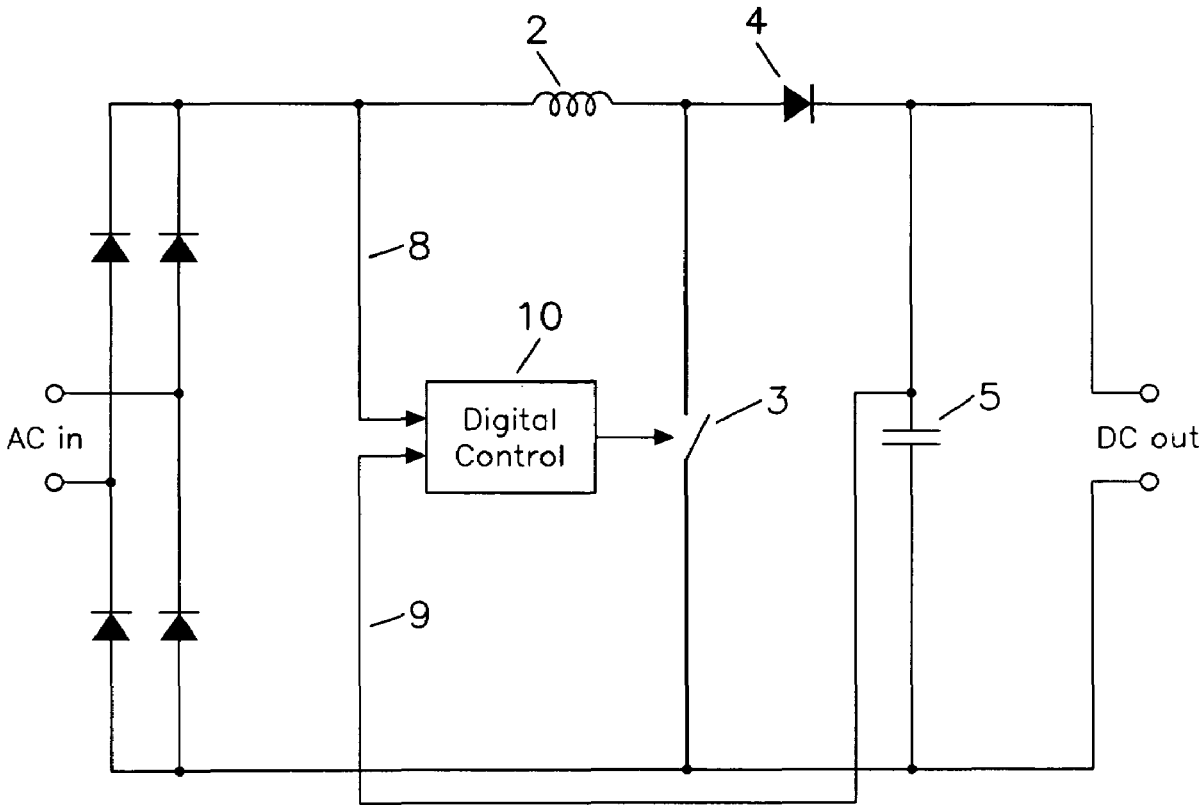
FIG. 2 is a diagram of a PFC power supply configured according to one embodiment of the present invention.

A first embodiment is depicted in FIG. 2. Since the characteristics of inductor 2 are known and remain constant, the current through inductor 2 can be established without measuring it directly. This is possible by knowing when switch 3 is closed, the rectified AC input voltage 8 and the output voltage 9. This information is available to the controller 10. The elimination of current sense block 1 and current feedback path 7 is both new and useful.

The current through an inductor follows the equation well known in the art dI=TV/L, where L is the inductance, T is the time that voltage V is applied across the inductor and dI is the resulting change in the inductor current. Computing the inductor current from voltage and time values requires arithmetic operations such as divide, which are not reasonably tractable to perform in analog electronics. The present state of the art uses sensing circuits to directly measure the current, whereas the present schemes utilize digital processing techniques to apply unique control schemes.

Referring again to FIG. 2, the present invention uses digital computations in control block 10 to solve equations related to the current through the components of the PFC power supply. These components include the inductor 2, the switch 3, the diode 4, the capacitor 5, and the final load.

In one embodiment, the digital controller processes an equation for the average current through inductor 2. The desired average inductor 2 current is calculated per switching pulse as a function of the time that switch 3 is closed and is inverted to solve for the required switch 3 closed or 'on' time. This average inductor 2 current is useful because this current is also the average AC input current. As previously noted, the purpose of the PFC function is to control this AC input current to keep it proportional to the rectified AC input voltage. Therefore, control element 10 directly solves the average inductor 2 current equation each switching pulse to determine the switch 3 closed time to keep the AC input current proportional to the AC input voltage. This is one of the features of the PFC operation and is accomplished without sensing and/or measuring the inductor current.

Figure 3:
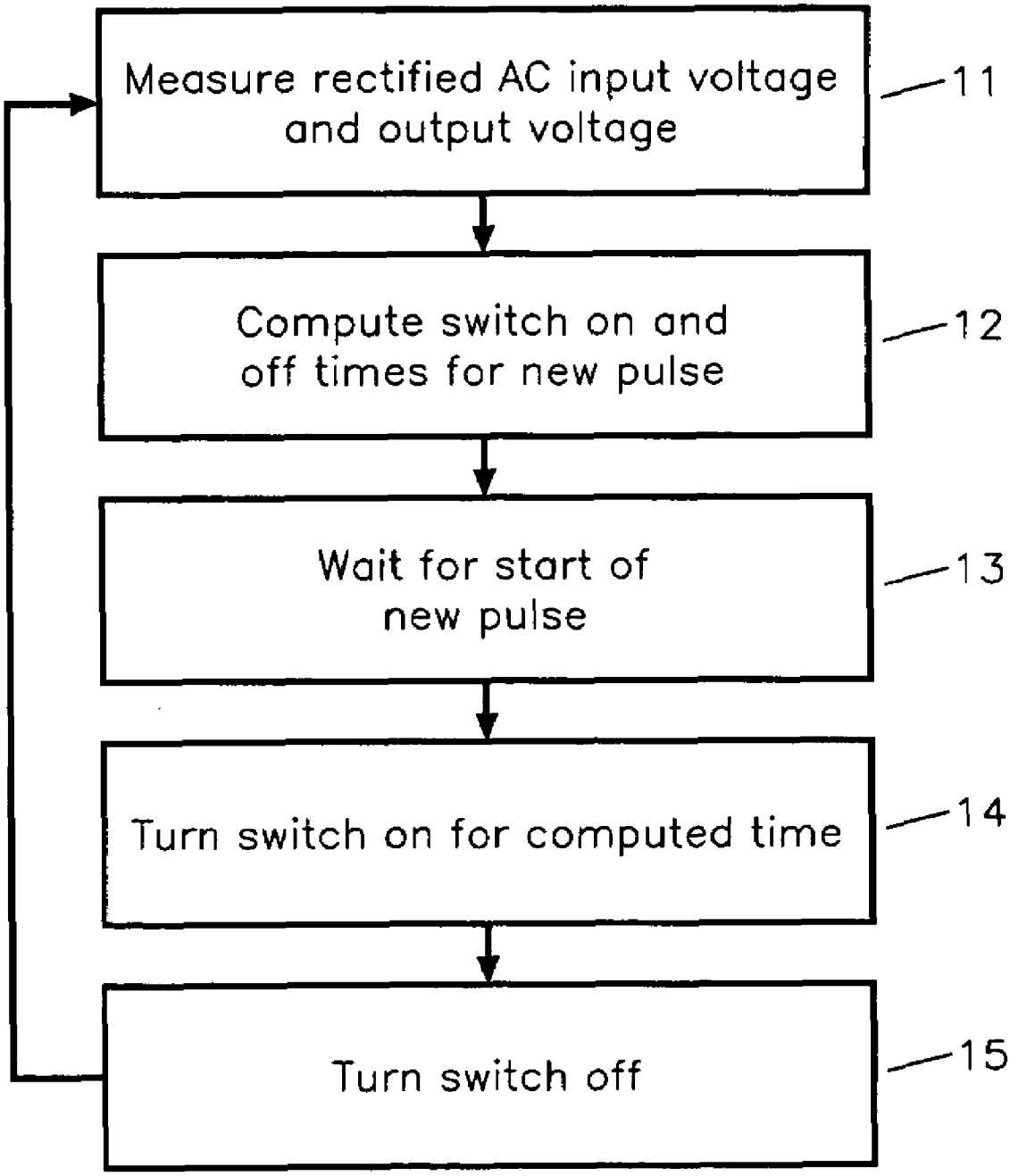
FIG. 3 is a flowchart illustrating a methodology configured according to one embodiment of the present invention.

The overall PFC process is illustrated in FIG. 3. The process shown in FIG. 3 is performed each switching pulse. Typically, the first step 11 measures the input and output voltages of the PFC power supply. In an embodiment depicted in FIG. 2, the input voltage is the rectified AC input presented to the control block 10 by sense connection 8. Likewise, the output voltage is presented to the control block 10 by sense connection 9. Because some computation must be performed on these values before the switching element can be turned on for the next pulse, these measurements are necessarily made before the switching pulse interval that will be controlled by their values. In other words, there will be generally some lag or delay between when the voltages are measured and the switching pulse derived from those measurements is performed. The measurements will often be taken synchronous to the start of the switching pulse so they represent the voltages one switching pulse length before the pulse they control. The average lag in that case is ½ switch pulse durations. This lag is usually a small fraction of the AC input cycle time, and is typically ignored. For example, with a 50 KHz switching frequency and 60 Hz AC input frequency, 1½ switching pulse durations is only a 0.65 degrees phase lag.

Those skilled in the art will see that it is possible to correct for much of this lag, if necessary. The lag described above is due to the approximation that the input voltage is constant over the duration of 11/2 switching pulses. As the example illustrated, this is a sufficiently good approximation in most cases. However, a better approximation is to assume that the slope of the AC input is constant over the 11/2 pulse durations. In other words, assume that the amount of change in the voltage from one switching pulse to the next is constant. Mathematically, this is the first order approximation. By measuring the slope over the last two samples, the voltage in the center of the next switching pulse can be extrapolated to a very good approximation with slightly more processing. Higher order approximations are possible but require more processing power and storage requirements. Any correction applied to the measured values is within the scope of the measurement step 11.

The next step computes the switch 'on' and 'off' times for the new pulse 12. As shown in FIG. 3, the input measurements are used to compute the switching element 3 'on' and 'off' times for the next pulse. In the case of fixed switching frequency, the only value to compute is the switching pulse 'on' time, since switching pulses start at regular intervals. It should be noted that the topology depicted in FIG. 2 is not limited to a fixed switching frequency. In addition, the present invention is not limited to the boost PFC topology which is described herein to illustrate the schema of the present invention. The concepts and teachings of the present invention are applicable to any of the PFC topologies and this should be readily appreciated by those skilled in the art.

The next step 13 is to wait for the start of the new pulse. This step is required in many circumstances because processing is often overlapped with the production of the switching pulse. Many commercial microcontrollers have hardware modules that can produce a pulse or sequence of pulses on their own without software intervention once the parameters are set up by the software. The step of waiting for the start of the new pulse recognizes that the separate processes of computing the pulse parameters and producing the pulse should be synchronized. The actual implementation can vary depending upon the specific design and components. In an all-software implementation, an explicit wait step may be required. When a hardware repetitive pulse generator is employed, the measurement step 11 may be automatically synchronized to the pulse generator, and the software can set up the parameters for the next pulse any time before it begins. Many other synchronization schemes are possible, if required.

The next step 14 is to turn the switch 'on' for the computed time, and this step actually starts the new pulse. This corresponds to time 0 in FIG. 4. The next step 15 turns the switch 'off', which corresponds to the end of time interval T1 in FIG. 4. These processing steps may be performed in software, in dedicated pulse generation hardware, or in combination. However, FIG. 3 depicts the overall process independent of any specific implementation.

Referring again to FIG. 2, in a further embodiment, the boost switching power supply is operated in "discontinuous" mode as is well known in the art, wherein the current through inductor 2 reaches zero each time before switch 3 is closed, and a new switching pulse is started. One advantage of discontinuous mode is that diode 4 is not conducting when switch 3 is closed. This is useful because diodes are not perfect, and have a "reverse recovery" period that is known in the art. Ideally, a diode is a one way valve for current, and when forward biased, it acts as a closed switch and allows current to flow through it. In this ideal diode, when the voltage is reversed, it acts as an open switch and does not allow current to flow backwards. However, real diodes do not switch open instantaneously, and the reverse recovery time is the time in which the diode still conducts after the voltage is reversed across the diode. If switch 3 is closed before inductor 2 is fully discharged and diode 4 is therefore conducting, a large current will flow through capacitor 5, backwards through diode 4, and through switch 3 during the diode's reverse recovery time. These currents can be very large. In addition to wasting power, they can damage diode 4, switch 3, and possibly capacitor 5. Diodes with shorter reverse recovery times usually cost more than diodes with longer reverse recovery times. Suitably fast diodes that also operate at high voltages are generally unattainable. Thus, one advantage of the discontinuous mode is that the reverse recovery time of diode 4 becomes irrelevant since it is not conducting when switch 3 is closed.

In another embodiment, the boost switching power supply operates in discontinuous mode and at a fixed frequency. This means a new switching pulse is started, switch 3 being closed, at regular intervals. The only choice of the control element 10 is then how long to leave switch 3 closed each interval, or switching pulse. This is graphically diagrammed in FIG. 4.

Figure 4:
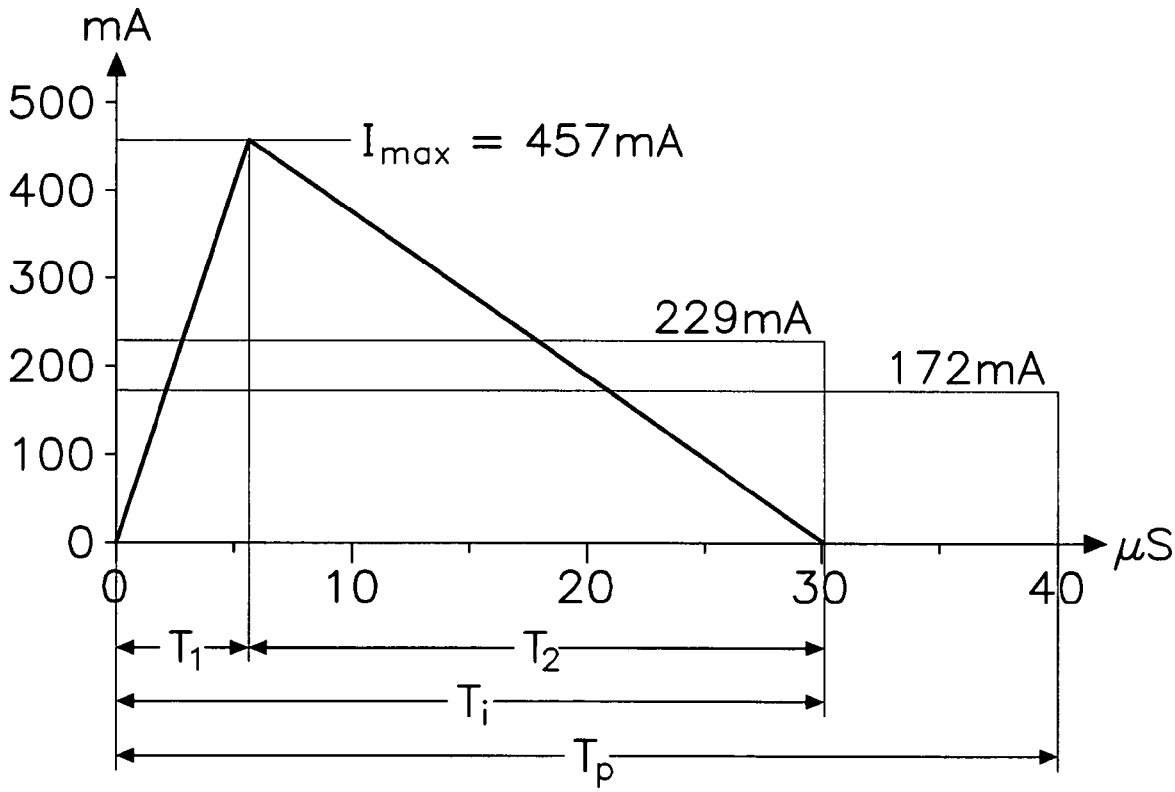
FIG. 4 shows the inductor current during one switching pulse.

FIG. 4 graphically shows the current through inductor 2 over the time of one switching pulse. In this example, the AC input is 115V RMS sine wave at 60 Hz, the nominal output voltage is 200V, the average power drawn from the AC input is 14 Watts, the inductance of inductor 2 is 2 millihenries, and the switching frequency is 25 KHz (40 uS switching period). The switching pulse in this example is at the peak of the AC input waveform.

At time zero, switch 3 is closed and remains closed during time interval T1. During this time, the instantaneous AC input voltage of about 163V is applied across inductor 2, and this causes the current to rise steeply to 457 mA during the approximately 6 μS time period that switch 2 is closed. Switch 2 is opened at the end of time interval T1. The instantaneous inductor current remains the same, but must now flow through diode 4. Since diode 4 now acts like a closed switch, the voltage applied to inductor 2 is the voltage on capacitor 5 minus the instantaneous rectified AC input voltage. Since the voltage on capacitor 5 is always higher than the highest point of the AC input voltage, the voltage across inductor 2 is now reversed. The inductor current then decreases at a rate proportional to the reversed voltage across it. Since the input and output voltages are essentially constant over one switching pulse, the current through the inductor 2 decreases linearly until it reaches zero at the end of time interval T2. Once the inductor 2 current reaches zero, diode 4 is no longer forward biased and therefore acts as an open switch. This keeps the inductor current at zero until the next time switch 3 is closed.

Time interval T1 is the total time that current is flowing thru the inductor. Because the currents during both time periods T1 and T2 are linear ramps with zero at one end and the peak current at the other, the average current is half the peak current during interval T1. In this example the average current is approximately 229 mA. To get the average inductor current over the whole switching pulse Tp, the average current during Ti is "spread" over the Tp interval. The result in this example is about 172 mA. Since this is the average current over a whole switching pulse, and switching pulses repeat continually, this is also the average current drawn from the AC input at that time.

One PFC function performed by control block 10 is to adjust T1 each switching pulse so that the average current for that pulse is proportional to the AC input voltage during that pulse. Note that although the AC input voltage obviously changes, each switching pulse is deliberately set as a small fraction of an AC input cycle such that the AC input voltage can be considered constant for the small duration of each switching pulse.

Equation 1 is an equation for performing PFC according to one embodiment of FIG. 2 and FIG. 4. An important aspect is that no measurements of any currents are used.

$$T1=\sqrt{2TpL(Vo-Vac)/VoR} \qquad \text{Equation 1}$$

Vac=full wave rectified AC input voltage as sensed via control line 8.

Vo=output voltage as sensed via control line 9.

Tp=total pulse period (1/switching frequency).

L=inductance of inductor 2.

R=resistance to present to the AC input.

T1=inductor 2 charge time.

As noted, T1 is the inductor charge time, or the time that switch 3 is closed. Tp is the total switching pulse time, which is fixed when the switching power supply is operating at a fixed frequency. For example, if the power supply is operating at the fixed switching frequency of 40 kilohertz, then Tp would be 25 microseconds.

Equation 1 shows the solution for T1 given all the information available to control element 10. However, 2TpL in Equation 1 are constants, and R is only varied slowly to roughly regulate the output voltage 9. For the purpose of providing power factor correction and rough regulation of the output voltage, these parameters can be combined into the single value K as shown in Equation 2. The value for K is slowly adjusted to approximately regulate the output voltage as needed, and the actual values of Tp, L, and R are not required to be explicitly known.

$$T1=\sqrt{K(Vo-Vac)/Vo} \qquad \text{Equation 2}$$

Vac=full wave rectified AC input voltage at control line 8

Vo=output voltage at control line 9

K=Adjustment value to control PFC input resistance

The embodiment of Equation 2 is computed digitally for each switching pulse, given the instantaneous measured values of Vo and Vac. These are available to control element 10 via feedback paths 9 and 8, respectively. Computing Equation 2 requires performing a divide and a square root. These operations are not reasonably tractable in analog electronics, but can be performed at sufficient speed with microcontrollers that have low enough cost/power to make them commercially feasible to include in PFC power supplies.

One embodiment uses additional digital computation of currents in control element 10 to provide better regulation of the output voltage. As described herein, the output voltage contains a ripple signal that is a necessary byproduct of the PFC function. The traditional output voltage regulation scheme is a tradeoff between reacting as quickly as possible to voltage deviations caused by varying demand from the load, and not reacting to the ripple caused by the PFC function. In the current state of the art, this is typically done by low pass filtering the output voltage feedback signal 9. The frequency response of the low pass filter is carefully adjusted to block the PFC ripple signal, but pass as much lower frequency components as possible.

In a further embodiment, a novel control scheme is used to adjust K in Equation 2 to control the output voltage more tightly than previously possible without interfering with the PFC function. Digital processing in control block 10 is again used to determine the PFC output current through diode 4. As shown in FIG. 2, all the current through diode 4 at each switching pulse occurs during time interval T2. The average current during T2 is half the peak current, and the T2 average current spread over the whole switching pulse is the average current through diode 4 during that pulse. In the example of FIG. 2, the average current during the T2 interval of about 24 uS is 229 mA. This value when spread out over the whole 40 uS switching pulse period is about 137 mA, although that value is not specifically depicted in FIG. 2. This value is the effective PFC output current at that time.

Since the PFC output current is known, the charge flowing through diode 3 each switching pulse is known. This charge must equal the sum of the charge added to capacitor 5 and the charge delivered to the output each switching pulse. The voltage on capacitor 5 before and after each switching pulse is measured, and if the capacitance of capacitor 5 is known, the charge added to capacitor 5 over a switching pulse can be computed. Since both the charge through diode 4 and that added to capacitor 5 are known, the charge drawn by the output load can also be computed. The charge multiplied by the switching period Tp equals the current drawn by the load during that switching pulse, and, if necessary, other parameters of the output load can be computed. For example, the power drawn by the load is the load current times its voltage, which is available to control block 10 via signal 9. The load's effective resistance is the load voltage divided by its current ($R_{eff}=V_{load}/I_{load}$).

When the load characteristics such as its current draw, power draw, and/or resistance are computed each switching pulse, this information can be used to regulate the PFC output to match the load as needed. In essence, the resistance presented to the AC input can be adjusted dynamically to match the requirements of the load. Since such adjustments are a function of only the load and not the output ripple due to the PFC operation, the reaction to load changes and therefore regulation of the output voltage can be more responsive. This dynamic resistance adjustment provides a superior scheme and without affecting the PFC operation. Furthermore, a smaller and therefore less expensive capacitor 5 can be used at the same level of output regulation, or better regulation can be achieved with the same capacitance.

The dynamic adjustment detailed above can be further simplified in various ways by those skilled in the art. For example, the average PFC output current need not be computed directly to obtain the output charge per switching pulse. This output charge is also the average inductor current during time interval T2 times the length of time interval T2. The PFC output charge per switching pulse is therefore half the maximum inductor current multiplied by T2. In general, actual computations are performed according to equations that are simplified to the extent possible, regardless of how they were derived.

Equation 3 shows the equation for tightly regulating the output voltage.

$$Ko = \frac{Vac^2 K - LC(Vo^2 - Vp^2)}{Vin^2} \qquad \text{Equation 3}$$

Ko=desired K due to measured output load.

Vo=output voltage at control line 9.

Vac=full wave rectified AC input voltage at control line 8.

Vp=output voltage measured at previous switching pulse.

Vin=RMS AC input voltage.

L=inductance of inductor 2.

C=capacitance of output capacitor 5.

Equation 3 is derived by assuming the final load draws a constant power as the output voltage changes. This is a valid assumption in the common case where the output voltage is the input to another switching power supply. Derivations can also be made for other assumptions, such as that the load draws a constant current, or is resistive such that current is proportional to the output voltage. These assumptions only differ in how the load varies in response to the output ripple. When the output ripple is small compared to its absolute voltage, these assumptions are approximately equivalent.

The actual computation in control element 10 can be simplified from Equation 3. The constants L and C of Equation 3 can be combined into a single constant. The output voltage, which is presented to control element 10 via feedback path 9, is sampled every switching pulse, wherein Vp is the measured value that was Vo during the previous pulse. The new value Vin in Equation 3 is the RMS voltage of the AC input. This is expected to vary slowly, and its square is derived from the various Vac samples over one or more AC input cycles according to techniques known in the art.

In a further embodiment, Equation 3 is computed each switching pulse. The result, Ko, is the K value of Equation 2 that would have exactly matched the average power drawn from the AC input to that drawn by the load. This is the K value that would maintain the average output voltage Vo at the current load power.

In another embodiment, K is set to the result of low pass filtering Ko. The purpose of the low pass filter is to smooth out the requirements of the load as presented to the AC input, and to filter out noise caused by measurement, quantization, and coupling of external signals. The advantage of the control scheme of the present invention is that the filter does not need to be adjusted to avoid reacting to the PFC ripple, since this has already been removed in the computation of Ko in Equation 3.

Simple low pass filters can be performed using digital computation using Equation 4.

$$FILT \leftarrow FILT + FF(NEW - FILT) \qquad \text{Equation 4}$$

Equation 4 shows how to update a digital low pass filter FILT with the new value NEW for one iteration of the filter.

FF is the "filter fraction" and is an adjustment that can vary from 0 to 1. It sets how "heavy" the low pass filter is set. Filters with low values of FF attenuate more random input noise, have a lower rolloff frequency, and are slower to respond to input value changes. Multiple filters as described by Equation 4 can also be cascaded where the output of one filter becomes the input to the next. Such multi-stage filters have faster response times at the same level of random noise attenuation, at the expense of higher computational costs.

One embodiment uses such a two stage filter to update K from the Ko values computed each switching pulse according to Equation 3. Specifically, Equations 5 and 6 are performed once each switching pulse to update K from the latest computed Ko value:

$$K_2 \leftarrow K_2 + FF(Ko - K_2) \quad \text{Equation 5}$$

$$K \leftarrow K + FF(K_2 - K) \quad \text{Equation 6}$$

Figure 5:
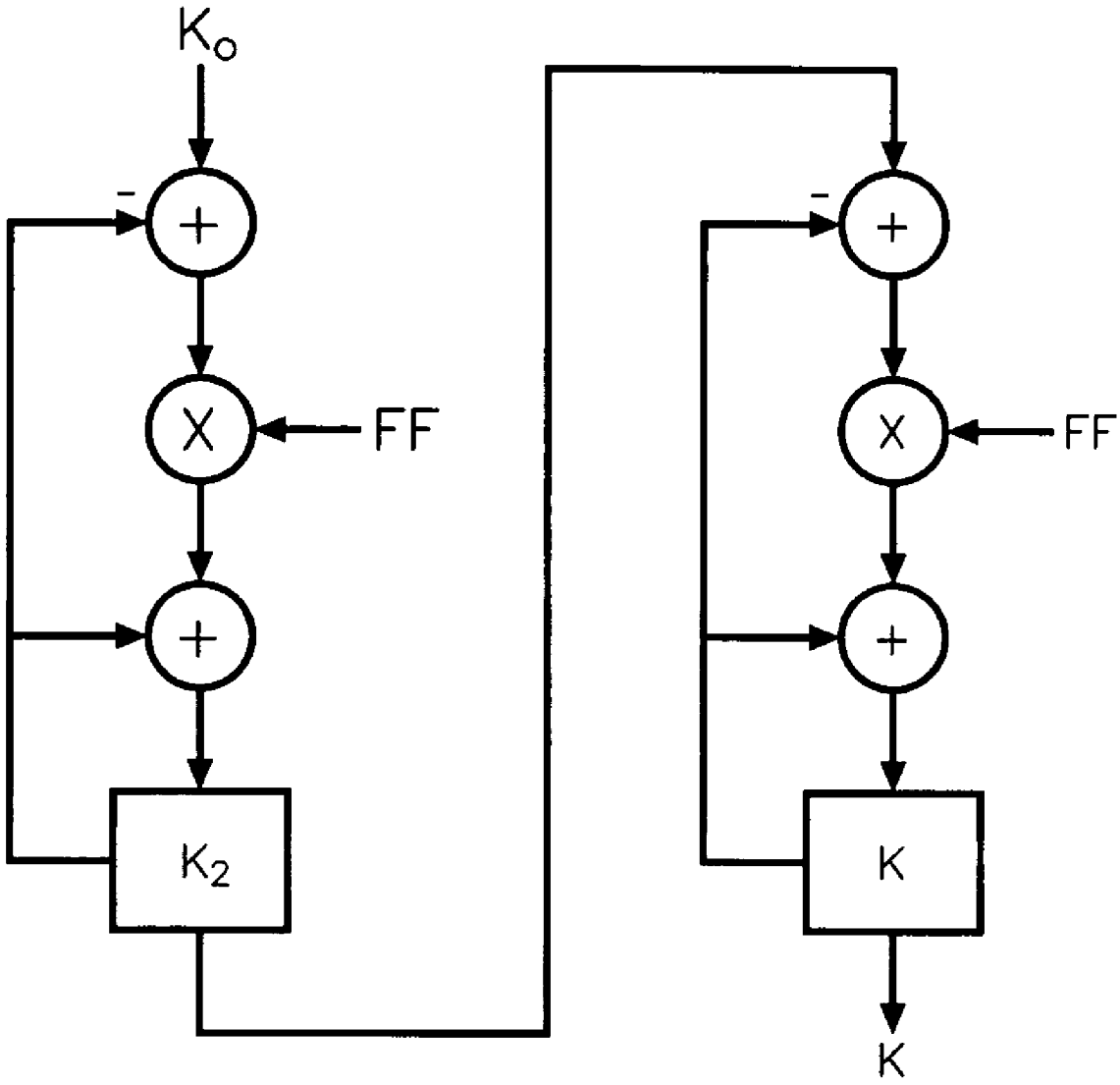
FIG. 5 shows a process of filtering the computed Ko value into the PFC control value K.

FIG. 5 depicts the operations performed each switching pulse to filter the computed Ko value to produce the new K value according to the example filter described herein.

K2 is an intermediate value that is the output of the first filter stage and the input to the second. FF is the filter fraction of the filters as discussed herein, wherein its exact value is a tradeoff between attenuating random noise on Ko and responding quickly to load changes, and is therefore implementation dependent. For example, an FF value of 1/64 results in a 95% step response time of about 300 iterations with random noise on Ko attenuated by about a factor of 4000. At 50 KHz switching frequency, the 95% step response time is about 6 milliseconds, or about 0.72 half AC input cycles at an AC input frequency of 60 Hz. Such fast response to output load changes is not possible in PFC supplies of existing designs since they would react significantly to the PFC ripple at such response times.

Equation 3 only indicates the desired K value from measured changes in the output voltage. Some feedback of the absolute output voltage is still generally needed as in the traditional control scheme to keep the output voltage at its desired average level. However, this feedback can be heavily filtered because it is only needed to maintain the long term average level of the output voltage. The filter parameters can be easily set to block the output ripple due to the PFC function without compromising short term load regulation, because short term regulation is provided by the value from Equation 3. Such a filter can be implemented digitally according to Equation 4 as previously discussed.

Equation 3 is a function of the inductance of inductor 2 and the capacitance of capacitor 5. These do not need to be accurately known for the control method of Equation 3 to function effectively due to the closed loop control scheme. The product of L and C can easily be known to within 25% even when using inexpensive components. In many cases, a variation of 25% will still allow operation within acceptable limits. If not, there are various ways of determining the product of L and C. One such scheme is to measure changes of the output voltage with a known output power. In many applications the output power is known to be zero at various times, such as during startup.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A power factor controller for a switching power supply, comprising:

an AC input; and a power factor correction circuit coupled to said AC input and providing a DC output to a load, wherein said circuit comprises an inductor, a diode, a switching element, an output storage capacitor and a digital controller, and wherein said digital controller processes an equation that computes input current or values derived from said input current independent of any measurement of actual input current.

2. The power factor controller according to claim 1, wherein the current equation is processed each switching pulse to determine a closed time of the switching element to keep an AC input current proportional to an AC input voltage.

3. The power factor controller according to claim 1, wherein a current of said inductor goes to zero during each switching pulse.

4. The power factor controller according to claim 1, wherein a switching period (T1) of said switching element is calculated by:

$$T1 = \text{sqrt}(2*Tp*L*(Vo - Vac)/(Vo*R)).$$

5. The power factor controller according to claim 4, where at least two of said equation elements Tp, L, and R are combined into a Power Factor Correction (PFC) control value (K).

6. The power factor controller according to claim 4, wherein a Power Factor Correction (PFC) control value (K) is used for equation elements 2, Tp, L, R, and wherein said switching period (T1) is calculated by:

$$T1 = \text{sqrt}(K*(Vo - Vac)/Vo).$$

7. The power factor controller according to claim 1, wherein a set of load characteristics are used to adjust an effective resistance presented to said AC input and match the requirements of the load.

8. The power factor controller according to claim 1, wherein the controller processes a computed charge amount, wherein said charge amount is transferred to the output storage capacitor over a switching pulse, and wherein said controller uses said computed charge amount and at least two measurements of the output voltage to compute characteristics of said load.

9. The power factor controller according to claim 1, wherein the AC input is a fixed frequency.

10. A method for performing power factor correction of a switched power supply, comprising:

measuring an AC input voltage of an AC input;

measuring an output voltage; processing a switch 'on' time and a switch 'off' time for a new pulse to keep an AC input current proportional to the AC input voltage, wherein said processing is done based on said AC input voltage and said output voltage without a current measurement of said AC input;

switching a switching member 'on' for said switch 'on' time; and switching said switching member 'off' for said switch 'off' time.

11. The method according to claim 10, wherein said processing includes at least one of a divide function and a square root function.

12. The method according to claim 10, further comprising computing an output voltage ripple.

13. The method according to claim 12, further comprising subtracting the output voltage ripple from a measured output voltage and adjusting an effective resistance to said AC input.

14. A control system for a switching power supply, comprising:

a power factor control circuit coupled between an AC input and a DC output wherein a digital controller of said power factor control circuit computes input circuit currents or values derived from said input circuit currents for regulating said power supply independent of any measurement of actual input currents.

15. The system according to claim 14, wherein the switching power supply operates in a discontinuous mode and at a fixed frequency.

16. The system according to claim 14, wherein said power factor control circuit comprises an inductor, a switching element, a diode, and an output storage capacitor.

17. The system according to claim 16, wherein a switching period (T1) of said switching element per pulse is: T1=sqrt (2*Tp*L*(Vo—Vac)/(Vo*R)).

18. The system according to claim 17, wherein certain values are assumed to be constants, and wherein a Power Factor Correction (PFC) control value (K) is used to compute said switching period:

$$T1 = \mathrm{sqrt}(K^* (Vo—Vac)/Vo).$$

19. The system according to claim 14, wherein the controller processes a computed charge amount over a switching pulse and uses said computed charge amount and at least two output voltage measurements to compute load characteristics.

20. The system according to claim 19, wherein said load characteristics are used to adjust the effective resistance presented to said AC input.

* * * * *